US005291943A

United States Patent [19]

Dhir

[11] Patent Number: 5,291,943

[45] Date of Patent: Mar. 8, 1994

[54] HEAT TRANSFER ENHANCEMENT USING TANGENTIAL INJECTION

[75] Inventor: Vijay K. Dhir, Santa Monica, Calif.

[73] Assignee: The Regents of the University of California, Oakland, Calif.

[21] Appl. No.: 998,536

[22] Filed: Dec. 29, 1992

[51] Int. Cl.[5] ..... F28F 13/12

[52] U.S. Cl. ..... 165/109.1; 165/174; 165/908; 138/38

[58] Field of Search ..... 165/109.1, 174, 177, 165/178, 908, 118; 138/38

[56] References Cited

U.S. PATENT DOCUMENTS

| | | | |
|---|---|---|---|
| 1,184,936 | 5/1916 | Falkenwalde | 138/38 |
| 2,424,441 | 7/1947 | Edmonds | 138/38 |
| 2,949,935 | 8/1960 | Edmonds | 138/38 |
| 3,016,067 | 1/1962 | Edmonds | 165/174 X |
| 3,274,752 | 9/1966 | Huyghe et al. | 165/908 X |
| 4,248,296 | 2/1981 | Jazek | 165/118 |
| 4,848,447 | 7/1989 | Sladky | 165/174 X |
| 5,054,547 | 10/1991 | Shipley | 165/174 X |

*Primary Examiner*—John Rivell
*Attorney, Agent, or Firm*—Michael J. Ram

[57] ABSTRACT

A process for improving the efficiency of heat transfer to a flowing fluid in a tubular heat exchanger by placing an injector on the inlet of each heat exchanger tube, the injector designed to create tangential flow in the tube. The injector used to generate tangential flow comprises a tubular cap with multiple passageways therethrough so that fluid entering the passageways enters the heat exchanger tube along a line tangent to the circumference of the hole extending along the length of the heat exchanger tube. A significant increase in heat transfer at the same pumping power is obtained as a result of the cross sectional shape of the passageway and the dimensions thereof in relationship to the inner diameter of the heat exchanger tube.

15 Claims, 6 Drawing Sheets

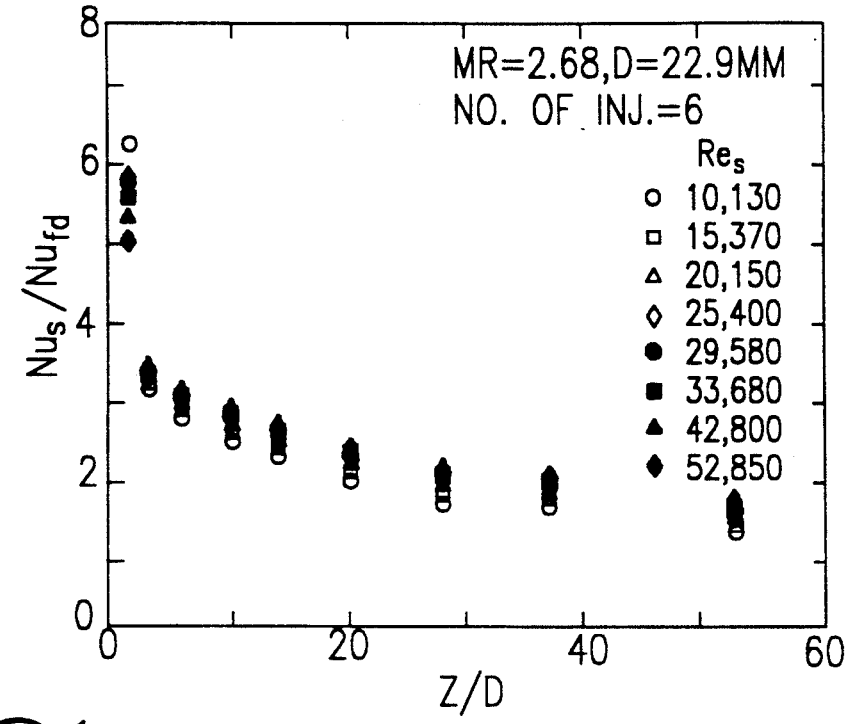
FIG. 6 HEAT TRANSFER RESULTS FOR SWIRL FLOW WITH 6 INJECTORS
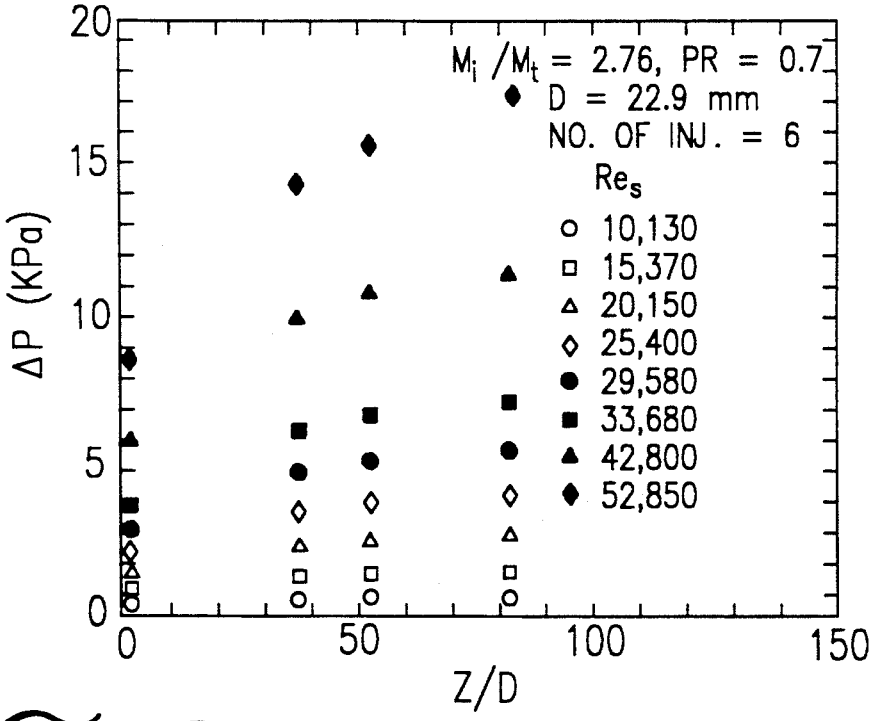
FIG. 7 PRESSURE DROP FOR SWIRL FLOW WITH 6 INJECTORS

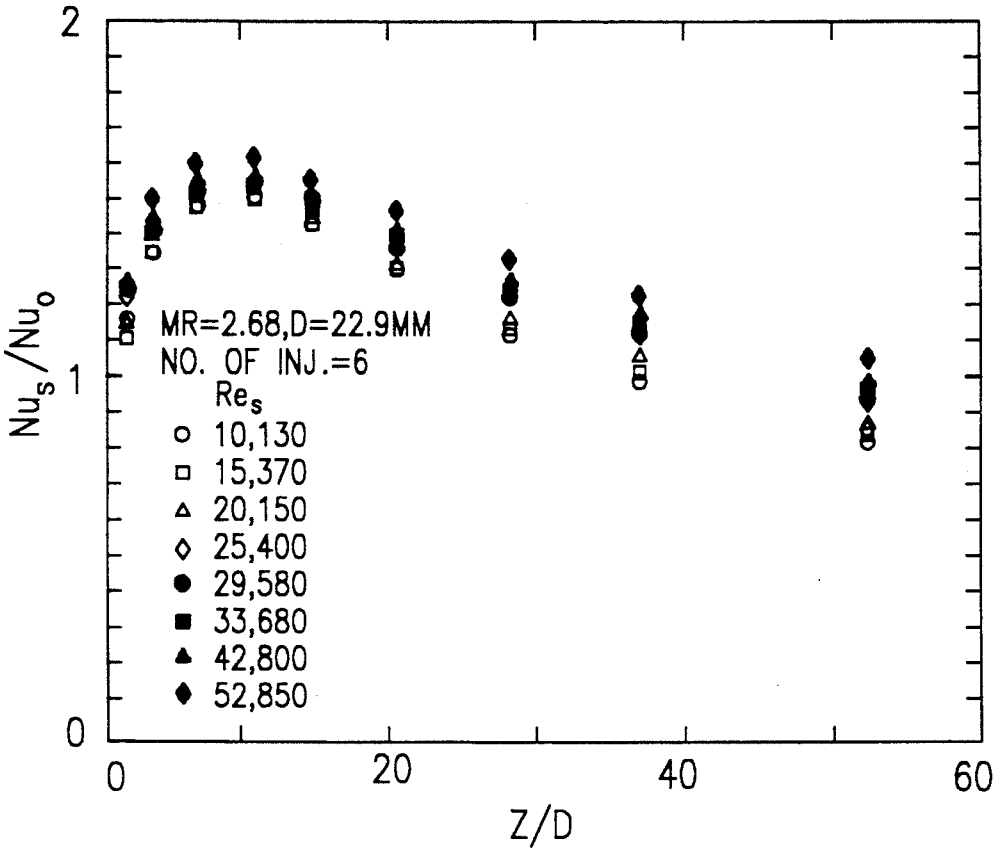
FIG. 8 RATIO OF NUSSELT NUMBER FOR SWIRL FLOW WITH 6 INJECTORS TO THAT FOR PURELY AXIAL FLOW

HEAT TRANSFER ENHANCEMENT USING TANGENTIAL INJECTION

BACKGROUND

The present invention relates to a process for improving heat transfer in flowing fluids by introduction of the fluid tangential to the internal wall of a heat exchanger. The invention further relates to heat exchanger structure designed to cause tangential introduction of the flowing fluid.

A common problem in processing fluids, particularly gases, is the heating of the fluid by transfer of heat from the surrounding equipment. A reduction in the overall resistance between a heat source and a heat sink for a given thermal load, as measured by an increase in the heat transfer coefficient, will result in a smaller heat exchanger, and therefore a lower equipment cost. Alternately, a reduction in the resistance to heat transfer will result in more efficient operation of the heat exchanger and the ability to process more fluid or to increase the temperature of the exit fluid without increasing the energy expended. It is known that an increase in the flow velocities of the fluid under fully developed turbulent flow will increase the heat transfer coefficients. However, pressures generated by increased flow increase at a much faster rate. Consequently, heat transfer rates per unit of pump power will actually decrease with the increased velocity.

Another approach to enhancing the heat transfer coefficients is to alter the hydrodynamic characteristics of the fluid flowing through the system by modifying the surface characteristics or configuration. This can be accomplished by passive means, such as surface roughness or the placement of fins or straight or twisted tape inserts, or active means, such as fluid oscillation, surface vibration, injection or suction at the heat transfer surface or the addition or generation of a second phase in the flowing stream.

Experimentation has shown that a maximum of about twenty percent increase in heat transfer at a constant pumping power basis can be generated by use of twisted tapes in the fluid flow path. For Reynolds numbers from 5,000 to 30,000 heat transfer can be enhanced 40% to 200%. However, the friction factor increases to between 160% and 1110%. Thus, the loss in pumping power exceeds the gain in heat transfer, resulting in a net decrease in heat transfer at constant pumping power. Additionally, use of twisted tapes and related devices are only effective at lower Reynolds numbers. Surface vibration or fluid oscillation has also shown about a 200% increase in heat transfer but only at low velocities and the technique requires complex equipment and the supply of and additional external power source.

A fourth method of enhancing heat transfer is to create a swirling motion in the fluid flowing through the heat exchanger. Results in tubular heat exchangers show that heat transfer and friction factors significantly decay in a distance from the inlet equivalent to 20 tube diameters and that losses due to friction increase at a rate greater than the increase in heat transfer. Injection induced swirl on single phase heat transfer has been shown to increase the heat transfer coefficient 6 fold at a momentum ratio of about 9.6. However, on a constant pumping basis this results in only about a 20% enhancement of heat transfer.

In a modified procedure to create swirling motion, it was proposed that a portion of the fluid be injected tangentially while additional fluid is injected axially. It was theorized that the swirling flow created would cause the hotter fluid near the wall to move toward the center, thus resulting in a thinning of the thermal boundary layer and an increase in the heat transfer (Kreith and Margolis, "Heat Transfer and Friction in Turbulent Vortex Flow", *Applied Scientific Research*, Vol. 8, 1959, p. 457–473). However, they never tested this concept. Weede & Dhir ("Critical Heat Flux Enhancement Using Long Tangential Flow Injection", *Nuclear Technology/Fusion*. Vol. 4 (Sept. 1983, pp. 483–488) demonstrated, on a subcooled fluid (Freon-113) a net enhancement, at a constant pumping basis, of 40%. However, to do so fluid had to be injected at several locations along the heat exchanger tube.

Dhir et al ("Enhancement of Forced Convection Heat Transfer using Single and Multi-stage Tangential Injection", *ASME HTD*. Vol. 119. (Dec. 1989) have reported on experimentally determined enhancement of heat transfer with air as the test fluid and Reynolds numbers between 15,000 and 58,000. The air was injected tangential to the inner walls of the heat exchanger tubes through square edged injectors extending perpendicular from the tube surface. The net enhancement of heat transfer, at constant pumping power, was between 3% and 14% depending on the momentum ratio. It was also found that the effectiveness of the system is highly dependent on the ratio of the rates of tangential to total momentum fluxes.

While various different techniques have been theorized or demonstrated to increase heat transfer, the frictional effects and other countervailing forces limit the capacity to increase heat transfer at the same pumping power. These alternate techniques may also require substantial changes to the heat exchanger equipment and/or the supplying of additional energy to the system.

Thus there is a need for a simple method to significantly increase heat transfer without a substantial modification of the heat exchange equipment or the addition of substantial pumping energy to move the fluid through the system. There is a further need for a simple equipment modification which will allow a substantial increase in heat transfer without increasing the energy to pump the fluid and which will not significantly decrease the flow of fluid through the heat exchanger.

SUMMARY

These needs are met by the present invention which comprises a process for enhancing the heat transfer of flowing fluids, and devices for use in that process. In particular the device comprises an injector in the form of a cap that can be placed over the inlet end of a heat exchanger tube. In particular, the injector has a tubular side wall, a closed end and an open end, the open end having an inner diameter approximating the outer diameter of the heat exchanger tube to which it is applied. Several holes or passageways penetrate the tubular side wall. The passageways direct the flow of fluid into the lumen of the tube such that the fluid enters the tube tangential to the inner wall of the tube. In a preferred embodiment, the passageways are cylindrical with a portion of the wall of the cylindrical passageway which extends from the entry end to the exit end of the passageway being coextensive with a line tangent to the inner wall of the heat exchanger tube. In a most preferred version, the inlet end of each passageway is at the outer surface of the wall. Further, improvement is obtained if the passageway entry does not present a sharp edge to the entering fluid. The enhancement of heat transfer, when compared with presently known methods of enhancement, is most noticeable at higher Reynolds numbers, namely, Reynolds numbers from 10,000 to 100,000. Additionally, maximum enhancement of heat exchanged is obtained when the ratio of area of the passageways to the cross sectional area of the lumen of the heat exchanger tube is about 2:5.

DRAWINGS

These and other features, aspects and advantages of the present invention will become better understood with reference to the following description, appended claims, and accompanying drawings, where:

FIG. 6 is a graph showing the heat transfer results for swirl flow with the injector of FIG. 3.

FIG. 7 is a graph showing the pressure drop for swirl flow with the injector of FIG. 3.

FIG. 8 is a graph showing the ratio of Nusselt number for swirl flow for the injector of FIG. 3 compared to that for pure axial flow.

Figure 9B:
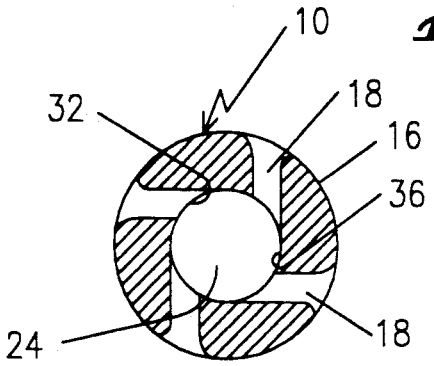
Figure 9A:
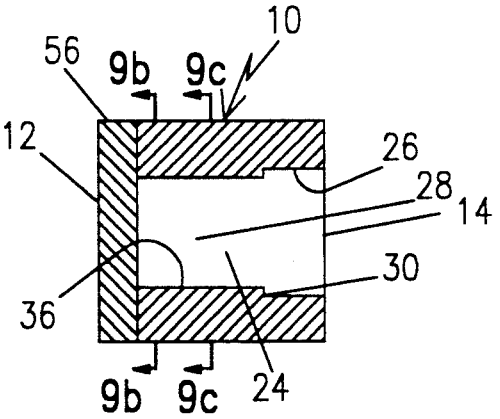

FIG. 9*a* is a cutaway side view of a second injector which has two sets of passageways which embody features of the invention.

FIG. 9*b* is a cross sectional view of the injector of FIG. 9*a* taken along line b—b of FIG. 9*a*.

Figure 9C:
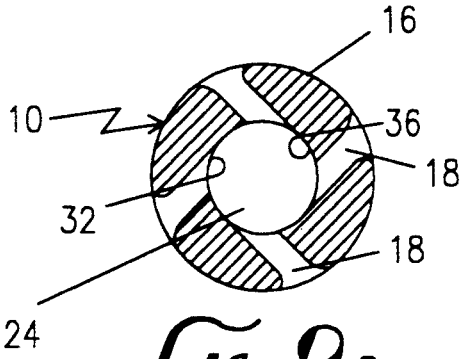

FIG. 9*c* is a cross sectional view of the injector of FIG. 9*a* taken along line c—c of FIG. 9*a*.

Figure 10:
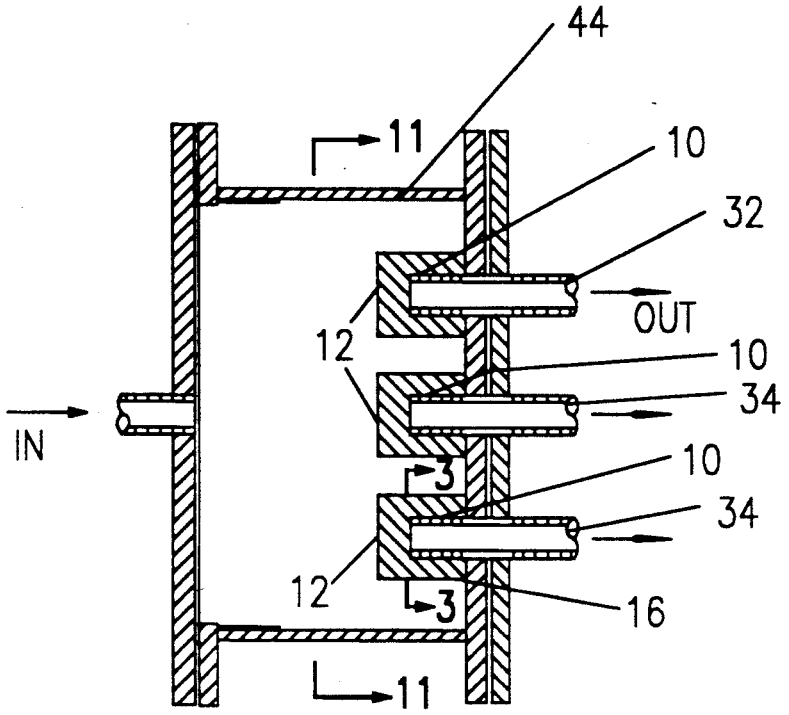

FIG. 10 is a cutaway view of a manifold enclosing multiple heat exchanger tubes, each tube having an injector embodying features of the invention attached thereto.

Figure 11:
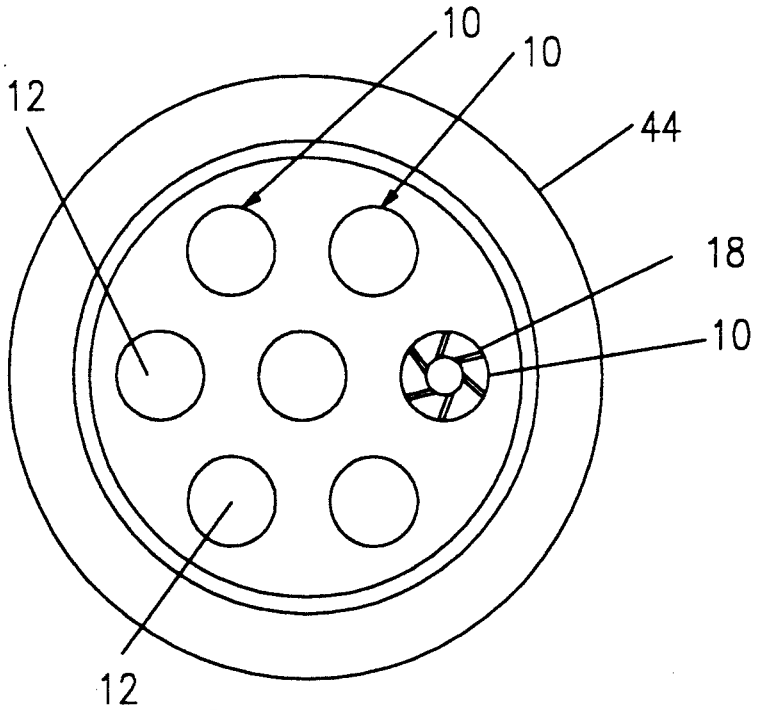

FIG. 11 is a cross sectional view of the manifold of FIG. 10 taken along line 11—11 in FIG. 10 showing the injectors mounted on the heat exchanger tubes, one of the injectors being cut away along line 3—3 of FIG. 10.

Figure 1:
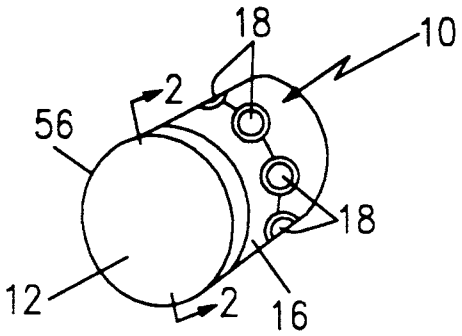
FIG. 1 is a perspective side view of an injector embodying features of the invention.
Figure 2:
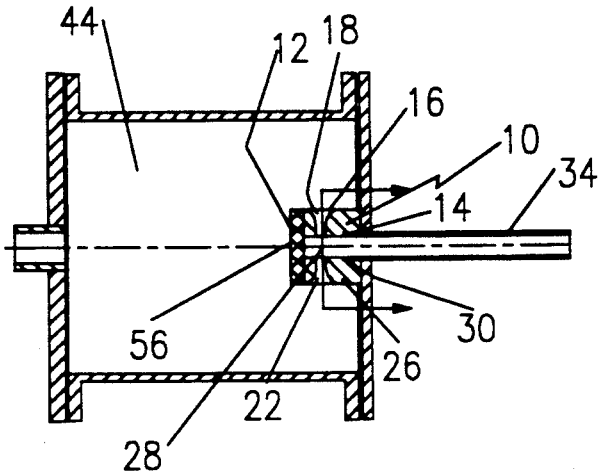
FIG. 2 is cutaway side view showing a manifold enclosing the injector of FIG. 1, the injector being mounted on a heat exchanger tube, the injector being shown in cross section taken along line 2—2 of FIG. 1.
Figure 12:
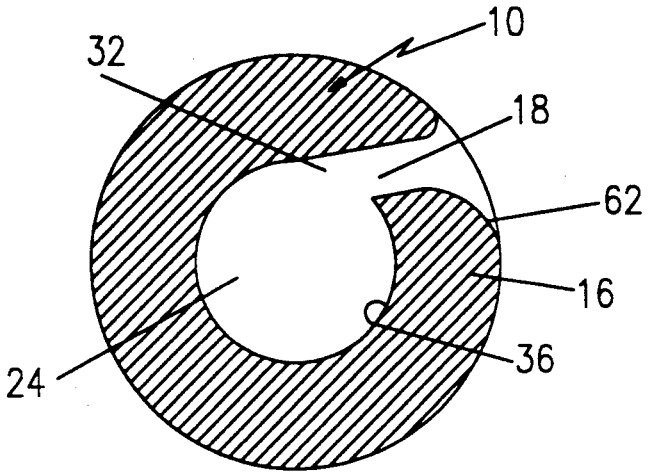

FIG. 12 is an enlarged cross sectional view of a variation of the injector of FIG. 1 taken along line 3—3 of FIG. 2.

Figure 13:
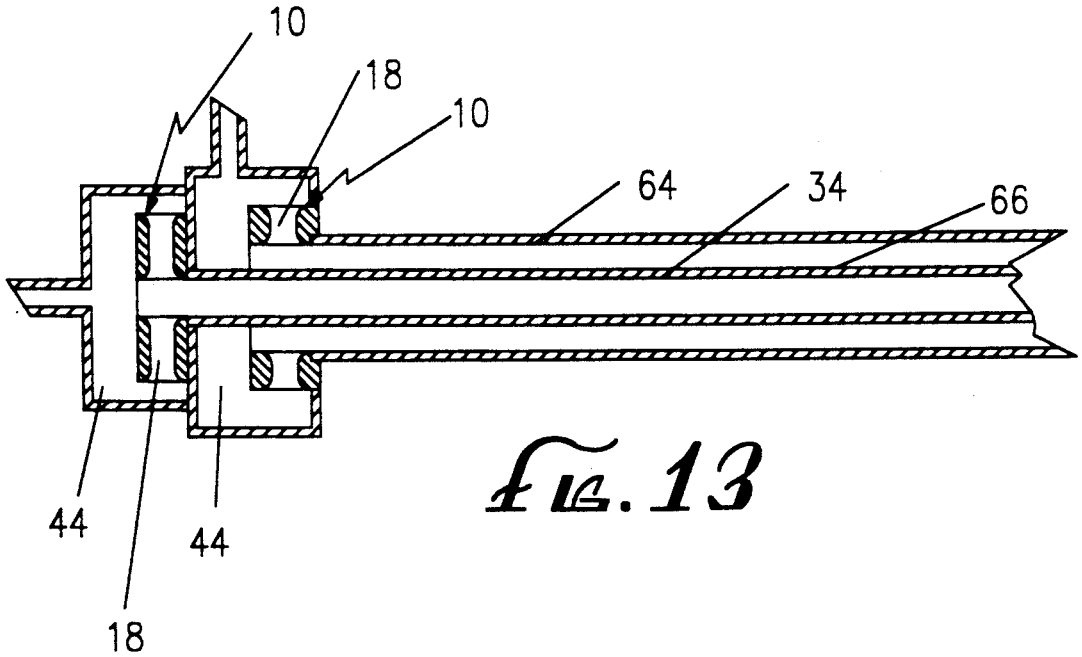

FIG. 13 is a cut away side view showing a manifold enclosing a first injector connected to an annular space and a second injector connected to a central tube in a double tube heat exchanger.

DESCRIPTION

Figure 3:
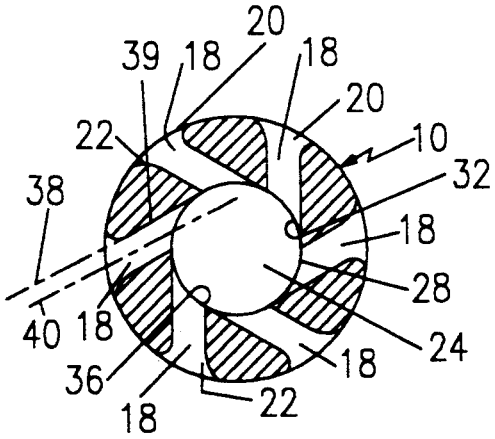
FIG. 3 is a cross sectional view of the injector of FIG. 1 taken along line 3—3 of FIG. 2.

FIGS. 1 through 3 show an injector 10 embodying features of the invention.

The injector 10 comprises a cylindrical tube having a closed end 12 and an open end 14 and a wall 16 extending therebetween. Piercing the wall 16 are one or more passageways 18. The passageways 18 are of substantially uniform cross section along a portion of the length thereof with the external end 20 of each passageway being at the outer surface of the wall 16. Further improvement results when the external end 20 of each passageway 18 includes a flared portion 22 so that fluid flowing into each passageway 18 does not encounter any sharp edges. This is in contrast to the prior art, injectors which utilize tubes extending from the surface of the heat exchanger tube, such as shown in FIG. 4.

The lumen 24 of the injector 10 is divided into a mounting portion 26 and an injection zone 28. The mounting portion 26 extends from the open end 14 of the injector 10 to a shoulder 30 located at a point partially along the length of the injector, the shoulder 30 being located between the open end 14 and the inner end 32 of the passageway 18. The injection zone 28 extends from the shoulder 30 to the inner end 32 and incorporates the inner ends 32 of the passageway 18, the inner ends being located approximately midway between the shoulder 30 and the closed end 12. The diameter of the mounting portion 26 of the lumen 24 approximates the outer diameter of the heat exchanger tube 34 so that the injector 10 can be readily mounted on the exposed end of the heat exchanger tube 34 in a fluid tight manner. The diameter of the injection zone 28 of the lumen 24 approximates the inner diameter of the heat exchanger tube 34 so that fluid flowing through the passageways 18 and along the injection zone 28 does not encounter a change in diameter or flow cross section as it enters into the heat exchanger tube 34.

The passageways 18 are designed so that fluid flowing therethrough will enter the lumen 24 tangential to the inner surface 36 of the injector wall 16 and will flow in a spiral manner along the length of the injector 10 into the heat exchanger tube 34. The spiral flow continues for a considerable distance along the length of the heat exchanger tube 34. A line 38 drawn tangential to the circumference of the lumen 24 extends along the length of the passageway 18 and is coextensive with the wall 39 of the passageway 18, the tangential line 38 being parallel to an axis 40 extending through the center of the passageway 18. This is repeated for each of the several passageways 18 through the injector wall 16. Thus, if the injector 10 has four passageways 18 each of four tangential lines 38, equally spaced along the circumference of the lumen 24 extend along a wall 39 of a passageway 18. FIG. 3 shows an injector 10 with six passageways 18. A single tangential line 38 and a single axis 40 are shown. While the invention contemplates the passageway 18 being at an angle to the tangent, optimum improvement in heat transfer enhancement occurs with the passageway coextensive with the tangent.

Figure 4:
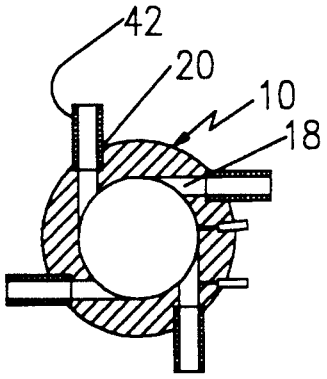
PRIOR ART FIG. 4
FIG. 4 is a cross sectional view of a prior art injector.

FIG. 4 shows an injector 10 of the prior art having four passageways 18. The prior art includes a tubular extension 42 added to the external end 20 of the passageway 18. In contrast to the prior art device, injectors of the invention eliminate the tubular extension 42 used in the prior art. In addition, a smooth tapered entry from the surrounding environment into each passageway 18 further improves heat transfer enhancement. FIG. 12 shows a cross sectional view of a modified injector 10 embodying features of the invention which, for clarity purposes, shows only one passageway. By comparison with the embodiment in FIG. 3, 9*b* and 9*c* (discussed below), it can be seen that the cross section of the passageway 18 is uniform for only about one-half of its length, the uniform portion being the innermost portion of the passageway 18. The passageway 18 then increases in diameter resulting in a smooth transition on its leading edge 62 with the outer wall of the injector, the outer diameter being about three times that of the uniform portion. Unexpectedly, it was found that this modification of the injector shown in the prior art had a profound effect on the enhancement of heat transfer in fluids flowing through systems incorporating the injectors embodying features of the invention.

Figure 5:
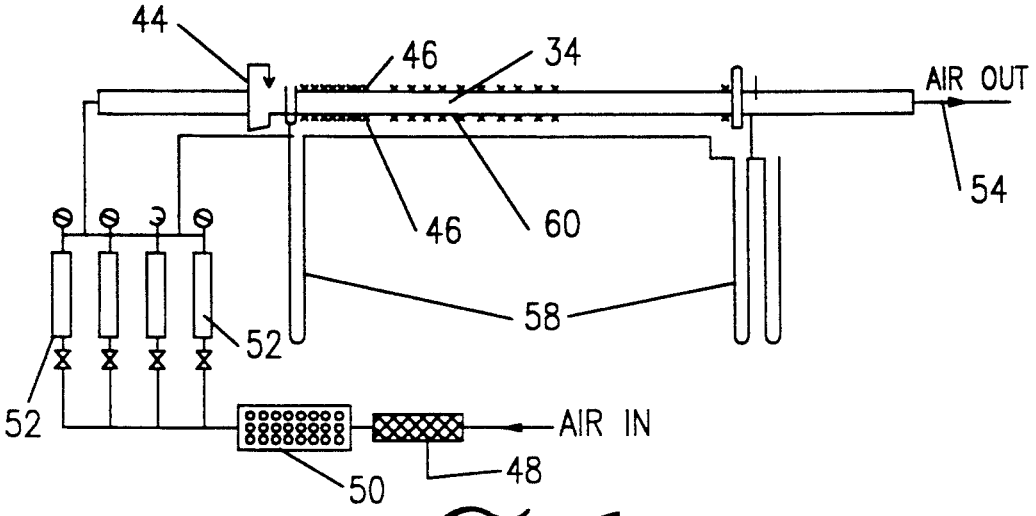
FIG. 5 is a schematic drawing of an experimental apparatus used to evaluate equipment incorporating heat transfer enhancing devices.

In order to study the effect of tangential injection on heat transfer and pressure drop, an experimental apparatus as shown in FIG. 5 was constructed. The apparatus utilized an injector 10 placed on a 22.9 mm (0.9") ID (1.0") OD and 1.83 m (6') long heat exchange tube 34. FIG. 2 shows an injector 10 placed in a fluid distribution chamber 44. Air supplied to the chamber 44 passed through passageway 18 in the injector 10 and into the heat exchanger tube 34 where it was heated. Pressure drops, temperatures, flow rates and pump power in the system were controlled and/or monitored.

Power input to the heat exchanger tube 34 was provided by a step down transformer which converted ordinary 115V/60Hz line voltage into a high current-low voltage AC source. The cables were attached to the test section by means of copper clamps. Voltage and current through the test section were monitored at all times to corroborate calculation of energy balance. Wall temperatures were measured with a set of 32 gage, type-K thermocouples 46 installed along the tube axis. At each axial location, two thermocouples 46 are installed on the tube surface 180° apart on the diameteral plane parallel to the horizontal. All of the thermocouples 46 were electrically insulated from the test section by a thin film of mica to eliminate stray signals which may result from the voltage which is applied across the test section. The tube was insulated by wrapping 25.4 mm (2") thick fiberglass material (not shown) around the tube. Air temperatures in the chamber and at the exit of the test section were measured to obtain the bulk temperatures at the inlet and the exit. Four pressure taps were located on the tube and one was on the chamber wall to measure the pressure drop. In order to remove moisture and entrained particles present in the air stream, a filter 48 and a 101.6 mm (4") in diameter and 2 m long PVC pipe filled with calcium sulfate 50 were installed in the line at a point before air enters the flow meters 52. This is the same equipment arrangement disclosed by Dhir at the Winter Annual Meeting of the Society of Mechanical Engineers, Dec. 10–15, 1989.

In order to determine the energy loss across the wall of the test section, experiments were performed without air flowing inside the test section. These experiments allowed the determination of energy loss coefficient, $h_l$, which is defined as $$h_l = \frac{q_l}{T_w - T_a} \tag{1}$$

where $q_l$, is the energy loss heat flux, $T_w$. is the test section wall temperature and $T_a$ is the ambient temperature. The experiments were conducted by closing all the valves in the system and applying a small amount of power to heat the test section. Wall temperatures were monitored and recorded to calculate $h_l$. Energy loss coefficient was found to have a high value near the inlet of the test section, which is due to conduction between the test section and the chamber. Thereafter, the heat loss coefficient decreased rapidly to a small value and stayed fairly constant along the test section. With this set of energy loss coefficients, the energy loss at any location along the test section could be determined for each experiment, as long as the wall temperature was not significantly different from that observed in the experiments with no flow.

When fluid was flowing through the system, the rate of heat input to the fluid was calculated from the temperature rise of the fluid through the test section as $$Q = m_f c_p (T_{exit} - T_{in}) \tag{2}$$

The power input to the test section was determined from the voltage and current measurements. This power input, Q, was generally within a few percent of that determined from Equation (2). The average wall heat flux was calculated from the total power input as $$q_w = \frac{Q}{\pi D_h L} \tag{3}$$

where L is the heated length of the test section. Since the current through the test section is constant, the local wall heat flux is directly proportional to the local resistivity of the test section. A correction to the wall heat flux to account for variation in electrical resistance with temperature can be made as $$q'_w = q_w[1 + \epsilon(T_w - T_w)] \tag{4}$$

where $\epsilon$ is the temperature coefficient of resistivity. For stainless steel, $\epsilon$, is about $1 \times 10^{-3} K^{-1}$ which results in a 2% correction near the exit. The average wall temperature $T_w$ in Equation (4) was obtained by averaging the wall temperature in the axial direction. The wall heat flux that was imposed on the fluid was obtained by subtracting Equation (1) from Equation (4) as $$q_w = q'_w - q_l \tag{5}$$

Equation (5) was not corrected for conduction along the tube since the effect of axial conduction was found to be negligible. The local bulk temperature of the fluid was then obtained by integrating the local wall heat flux from the inlet as $$T_b = \frac{\pi D_h \int_0^Z q_w dZ}{m_f c_p} + T_{in} \tag{6}$$

Once the bulk temperature was obtained, local Nusselt number and Reynolds number were calculated using $$Nu = \frac{q_w D_h}{k_f (T_w - T_b)} \text{ and } Re = \frac{4 m_f}{\pi D_h \mu_f} \tag{7}$$

where all properties were evaluated at the bulk temperature. In obtaining the Reynolds number, the fluid viscosity at exit bulk temperature was used.

Evaluation of the heat transfer enhancement obtained using different injector configurations were initiated by directing air flow into the air filter 48 and the PVC pipe 50 filled with calcium sulfate. The air exiting the PVC pipe 50 was then directed through the flow meters 52 feeding the injectors 10. Power was then varied to maintain a reasonable temperature difference ($T_w - T_b$) at the exit 54. It was found that a wall temperature difference ($T_w - T_b$) of about 40° K. at the exit 54 provided sufficient resolution in temperature measurement while keeping radiative heat exchange to a minimum.

The system was allowed to run for about one hour before data collection began. Data were collected at 15 minute intervals until no change in measured temperatures was observed. Once steady state had been reached, a printout of temperature data was obtained. The Nusselt numbers calculated were accurate to within ±9%. The ratio $Nu/Nu_{fd}$ (local Nusselt number/fully developed Nusselt number), however is believed to be accurate to within ±8%. Error bound on the ratio $Nu/Nu_{fd}$ is reduced because the contribution due to the uncertainty in the flow rate cancels out.

In order to investigate the net enhancement based on a constant pumping power, experiments for the purely axial flow and the swirl flow at the same pumping power were conducted. Axial flow was obtained by sealing the external ends 20 of the passageways 18 and the removing the injector cover 56 from the injector 18 so that the fluid could enter the heat exchanger tube 34 without swirl flow being generated. The chamber pressure and the pressures just downstream of the injector 10 and at distances 37, 53, 73 and 107 hydraulic diameters downstream of injector 10, which was enclosed in distribution chamber 44, were measured with a water manometer 58. This allows a calculation of the pressure drop through the injector 10 and through the test section 60. With purely axial flow, the pumping power can be calculated as $$W_o = V_o A_t[\Delta P_i + \Delta P] \quad (8)$$

where $\Delta P_i$ and $\Delta P$ are the pressure drops through the entrance and the exit and through the test section, respectively. Similarly, the pumping power with swirl flow can be calculated as $$W_s = V_s A_t[\Delta P_j + \Delta P] \quad (9)$$

where $\Delta P_i$ includes the tube exit pressure loss and the pressure loss through the injector 10 and $\Delta P$ is the pressure drop through the test section 60. In the experiments with purely axial flow, the flow rate was adjusted so that the pumping power was the same as in swirl flow. The net enhancement was then represented by $$E = \frac{Nu_s}{Nu_0} = \frac{\int_0^{Z/D_h} Nu_s d(Z/D_h)}{\int_0^{Z/D_h} Nu_0 d(Z/D_h)} \quad (10)$$

A set of experiments was conducted with air injected through an injector 10 such as shown in FIG. 12 having six passageways (FIG. 3). Each of the six passageways had a uniform diameter portion of 5.72 mm (0.225") and a tapered entrance with an entry radius of about 17 mm (0.555"). The injector wall thickness was about 0.55 inches. In order to experimentally evaluate the net enhancement, experiments under pure axial flow condition using the same pumping power were conducted. On a constant pumping power basis, for a 22.9 mm inside diameter (nominal 1") heat exchanger tube 34 that was 37 hydraulic diameters long, exit Reynolds numbers of 18720, 29170, 38340, 47480, 56410, 63690, 80940 and 97780 were obtained for purely axial flow. At the same level of pumping power, exit Reynolds numbers of 10130, 15370, 20150, 25400, 29580, 33680, 42800 and 52480 were obtained for swirl flow, respectively.

For a tube having a nominal diameter of 2 inches, optimum enhancement was obtained with an injector having six passageways, each within a diameter of about 11 mm. (0.44 inch) and a wall thickness of about 0.5 inches, resulting in a ratio of injector wall thickness to passageway diameter of about 1.15.

The normalized local Nusselt numbers for swirl flow are plotted in FIG. 6. As shown in FIG. 6, the heat transfer enhancement is greater for high Reynolds numbers. Pressure drop data for swirl flow are plotted in FIG. 7. About 50% of the total pressure drop occurs across the injectors. FIG. 8 shows, on a constant pumping power basis, the dependence on the axial distance of the ratio of the Nusselt number with swirl to that without swirl. Maximum enhancement in heat transfer occurs at about ten hydraulic diameters downstream of the injection location. This is due to the fact that purely axial flow develops fully thermally in about 10 diameters while swirl flow is still developing. Even at 37 hydraulic diameters enhancement is 15%. Table 1 shows, on a constant pumping power basis, the average enhancement for tubes having a length equal to 37 hydraulic diameters, and either a 22.9 mm (0.9") inside diameter or a 44.7 mm (1.76") inside diameter. It was found that for both tubes an enhancement from 34–45% is obtained. For comparison, the enhancement obtained for the prior art injector shown in FIG. 4, operating at the same $Re_o$, as listed in Table 1, is considerably less. The improved enhancement over prior art devices is most noticeable at higher Reynolds numbers.

TABLE 1

Net Enhancement in Heat Transfer for Swirl Flow with 6 Injectors.

| Invention | | | | Prior Art | |
|---|---|---|---|---|---|
| $Re_o$ | $Re_s$ | E (22.9 mm) | E (44.7 mm) | $Re_o$ | E |
| 9,500 | 5,400 | 1.47 | | | |
| 18,720 | 10,130 | 1.34 | 1.45 | 10,000 | 1.12 |
| 29,170 | 15,370 | 1.33 | 1.45 | | |
| 38,340 | 20,150 | 1.36 | 1.40 | 40,000 | 1.14 |
| 47,480 | 25,400 | 1.38 | 1.39 | | |
| 56,410 | 29,580 | 1.37 | 1.38 | | |
| 63,690 | 33,680 | 1.39 | — | | |
| 80,940 | 42,800 | 1.39 | — | | |
| 97,780 | 52,850 | 1.41 | — | 100,000 | 1.17 |

Further, it has been discovered that maximum enhancement of heat transfer can be obtained when six passageways of the same cross section are used and the sum of the area of the passageways is from about 0.10 to about 0.40 times the cross-sectional area of the internal diameter of the heat exchanger tube. With six passageways the diameter of each passageway is from 0.125 to about 0.25 times the diameter of the heat exchanger tube. An important factor appears to be the dimensional relationship between the diameter or cross section area of the passageways and that of the heat exchanger tube. The absolute value of the diameter or cross section of each passageway or the sum of the cross sectional area of the passageways does not appear to be critical. Also, the example uses 1 inch diameter and 2 inch diameter heat exchanger tubes. However, the heat transfer enhancement is applicable to any diameter tube as long as the ratio of dimensions is within the preferred range. Additionally, the thickness of the injector wall can range from 0.3 to 0.6 inches. A thickness greater than about 0.5 inches does not appear to further enhance heat transfer and the resultant larger diameters of the injector requires a greater spacing between heat exchanger tubes which is undesirable because the heat exchanger unit becomes too large. This preferred thickness results in a passageway length of from about 0.32 to about 0.775 long, depending on which portion of the passageway wall is measured.

FIGS. 9a–9c show a further version of the injector which has eight passageways 10, the passageways 10 being arranged in two sets of four passageways, the sets being spaced along the injection zone 28 of the injector. Also, as shown in FIGS. 9b and 9c the passageways 18 in a first set are offset from the passageway in the second set so that flow through passageways 18 on sets spaced apart will fill the flow space.

FIGS. 10 and 11 show multiple injectors 18 installed on multiple heat exchanger tubes located in a distribution chamber 44.

The invention contemplates from 2 to 10 passageways arranged in a single set or multiple sets of passageways arranged parallel to each other. Using more than one set of passageways in a single injector is also contemplated. Also, rather than arranging the passageways in parallel sets, they may also be arranged in various different ways such as in a spiral manner. In addition, the embodiment shown in FIGS. 3, 9b and 9c show the axis of the passageways being perpendicular to an axis through the center of the injector. The invention contemplates the axis of the passageway being at an angle other than 90° C. to the injector central axis such that the fluid enters the injection zone 28 tangential to the wall 16 as well as being angled towards the open end 14 or the closed end 12 of the injector 10.

Although the present invention has been described in considerable detail with reference to certain preferred versions and uses thereof, other versions and uses are possible. For example, the invention is applicable to any diameter heat exchanger tube and heat exchangers with multiple tubes. Also, the invention is not limited to injection of fluid into a tube in a shell and tube heat exchanger where a second heat transfer medium is in the shell space outside the tube. As shown in FIG. 13, injectors 10 embodying the invention can be applied to either the inner or outer tube, or both the inner 34 and outer tubes 64 in a heat exchanger having a tube within a tube such that a first fluid flows in the inner tube 34 and a second fluid flows in the annular space 66 between the tubes 34, 64. While the examples are all directed to injectors embodying the invention installed on the end of heat exchanger tubes, the addition of injectors embodying features of the invention along the length of the heat exchanger tube can also further enhance heat exchange, particularly when very long tubes are used. Therefore, the spirit and scope of the appended claims should not be limited to the description of the preferred versions contained herein.

What is claimed is:

1. A process for enhancing the heat transfer between a fluid flowing in a lumen in a tube and the wall of the tube, the tube having a defined length and the lumen having a defined cross sectional area, without increasing the power required to pump the fluid, comprising mounting on an inlet end of the tube a cap which allows swirl flow into the tube but which prevents axial flow along the tube, the cap having an open mounting end, a closed end spaced therefrom and a cap wall extending between the open mounting end and the closed end, the cap wall having one or more passageways of a defined cross sectional area extending from an outer surface of the cap wall to an inner surface of the cap wall, each passageway having a uniform cross sectional area for a first portion of its length and the remainder of its length increasing to a diameter at the outer surface of the wall of up to about three times the diameter of the first portion, said passageways being oriented so that fluid entering the passageway at the outer surface of the cap wall flows through the passageway and enters the tube tangential to the wall of the tube, causing swirl flow of the fluid along the tube for at least a substantial portion of the length of the tube, the sum of the cross-sectional areas of the passageways being from about 10% to about 40% of the cross sectional area of the lumen in the tube upon which the cap is mounted, the resultant enhancement of heat transfer at constant pumping power being greater than about 30%.

2. The process of claim 1 wherein each cap has 6 passageways, each passageway is circular in cross-section and has a diameter from about 0.1 to about 0.3 times the diameter of the tube, and the cap wall has a thickness of from about 0.3 to 0.6 inches.

3. The process of claim 1 wherein the tube has an inner diameter of about one inch, the cap has 6 passageways, therethrough, each with an uniform circular cross-section along a portion of its length the diameter of the uniform cross section of each passageway being from about 0.125 to about 0.250 inches, the thickness of the cap wall being greater than about 0.30 inches and the opening to the passageway at the outer surface of the wall has a diameter greater than about 0.25 inches to about 0.5 inches.

4. The process of claim 1 wherein each passageway has a uniform cross-section along a portion of its length, the sum of the areas of the uniform cross-sections of the passageways is from about 0.1 to about 0.4 times the cross-sectional area of the tube and the wall has a thickness which is at least about 1.15 times the diameter of the uniform cross-section of the passageway.

5. The process of claim 1 wherein the tube has an inner diameter of about two inches, the cap has 6 passageways, therethrough, each with a uniform circular cross-section along a portion of its length, the diameter of the uniform cross section of each passageway being from about 0.25 to about 0.50 inches, the thickness of the cap wall being greater than about 0.30 inches and the opening to the passageway at the outer surface of the cap wall has a diameter greater than about 1 to less than about 3 times the uniform diameter portion of the passageway.

6. The process of claim 1 wherein the heat transfer at constant pumping power is enhanced by about 30% to about 47% at Reynolds numbers from about 5,000 to about 100,000.

7. The process of claim 1 wherein the heat exchange has multiple tubes and each tube has a cap mounted on the inlet end thereof, each cap including spiral flow in the tube on which it is mounted.

8. A fluid distributor for placement on the inlet end of a heat exchanger tube, the fluid distributor capable of enhancing the transfer of heat between the tube and a fluid flowing through a lumen in the tube, the fluid distributor having an open end for mounting the fluid distributor on the inlet end of the tube, a closed end spaced therefrom to prevent the fluid from flowing in an axial manner along the tube while the fluid distributor is mounted on the tube, and a cap wall of a defined thickness, the tube having a central opening extending from the open end to the closed end, the central opening and the cap wall extending from the open end to the closed end, the wall enclosing a mounting portion of the central opening having a diameter substantially the same as the outer diameter of the tube and an injection zone of the central opening having a diameter substantially the same as the diameter of the lumen of the tube, the mounting portion being located at the open end of the fluid distributor, and the injection zone extending from the closed end of the distributor to the mounting portion, one or more passageways through the cap wall connecting the space surrounding the fluid distributor with the injection zone, each passageway having a uniform cross-sectional area along a portion of the length of the passageway and a smooth curve providing a transition from the passageway to the outer surface of the cap wall, the sum of the uniform cross-sectional areas of the passageways being from about 10% to about 40% of cross-sectional area of the injection zone, the defined thickness of the wall being at least about 1.15 times the diameter of the uniform cross-sectional area of the passageway.

9. The fluid distributor of claim 8 wherein the injection zone is about one inch in diameter, there are from 4 to 8 passageways, the passageways each have a diameter from about 0.125 to 0.25 inches and the cap wall is from about 0.3 to 0.5 inches thick.

10. The fluid distributor of claim 8 wherein the injection zone is about two inches in diameter, there are from 4 to 8 passageways, the passageways each have a diameter from about 0.25 to 0.5 inches and the cap wall is from about 0.3 to 0.6 inches thick.

11. The fluid distributor of claim 8 wherein the ratio of the sum of the areas of the passageways to the area of the injection zone is from about 0.1 to 0.4 and the wall thickness is greater than 1.15 times the passageway diameter.

12. A heat exchanger with enhanced heat transfer comprising:

a. a heat exchanger tube having a first heat transfer medium exterior thereto and a second heat transfer medium flowing through a lumen in the heat exchanger tube, b. distribution means mounted on the inlet end of the heat exchanger tube, said means causing the second heat transfer medium to move in swirl flow along the length of the heat transfer tube.

c. said distribution means comprising a closure blocking the second heat transfer medium from axial flow through the tube and incorporating passageways arranged at an angle to the tube inner surface so that the second heat transfer medium enters the tube tangential to the heat exchanger tube wall, the sum of the cross sectional areas of the passageways being from about 10% to about 40% of the cross sectional area of lumen in the heat exchanger tube, the passageway having an inlet end which presents a smooth surface to inflowing fluid.

13. The heat exchanger of claim 12 further including a core within the heat exchanger tube, the space between the core and the heat exchanger tube defining an annular space, the distribution means mounted on the inlet of the heat exchanger tube causing swirl flow in the annular space.

14. The heat exchanger of claim 12 wherein the core is a second tube and a second distribution means is mounted on the inlet end of the second tube for creating swirl flow inside the second tube.

15. A process for enhancing the heat transfer between a fluid flowing in a lumen in a heat exchanger tube and the wall of the tube, the tube having a defined length and the lumen having a defined diameter, without increasing the power required to pump the fluid, comprising mounting on an inlet end of the tube a cap which allows swirl flow into the tube but which prevents axial flow along the tube, the cap having an open mounting end, a closed end spaced therefrom and cap wall extending between the open mounting end and the closed end, the cap wall having one or more passageways of a defined cross section extending from an outer surface of the cap wall to an inner surface of the cap wall, said passageways being oriented so that fluid entering the passageway at the outer surface of the cap wall flows through the passageway and enters the lumen tangential to the wall of the tube, the heat exchanger tube has a second tube through the lumen thereof, the heat exchanger tube and the second tube define an annular space therebetween, and the cap causes swirl flow of fluid along the tube in the annular space for at least a substantial portion of the length of the tube, the sum of the cross-sectional areas of the passageways being from about 10% to about 40% of the cross-sectional area of the lumen in the tube upon which it is mounted, the resultant enhancement of heat transfer at constant pumping power being greater than about 30%.

* * * * *